US008678251B2

(12) United States Patent
Norman et al.

(10) Patent No.: US 8,678,251 B2
(45) Date of Patent: Mar. 25, 2014

(54) PACKAGE FOR AN ARTICLE TO BE WORN

(75) Inventors: Joshua James Norman, Cincinnati, OH (US); Debra Gay Gehring, Cincinnati, OH (US); Donald Carroll Roe, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 185 days.

(21) Appl. No.: 13/189,753

(22) Filed: Jul. 25, 2011

(65) Prior Publication Data

US 2012/0024914 A1 Feb. 2, 2012

Related U.S. Application Data

(60) Provisional application No. 61/367,983, filed on Jul. 27, 2010.

(51) Int. Cl.
*A41D 27/22* (2006.01)

(52) U.S. Cl.
USPC ..... 223/87; 223/85

(58) Field of Classification Search
USPC ..... 223/85, 87, 88, 92
See application file for complete search history.

(56) References Cited

U.S. PATENT DOCUMENTS

| | | | | |
|---|---|---|---|---|
| 1,547,951 | A | 7/1925 | Olson | |
| 2,940,646 | A * | 6/1960 | Richa et al. | 223/71 |
| 3,098,590 | A * | 7/1963 | Richardson | 223/71 |
| 3,255,939 | A * | 6/1966 | Buzzelli | 223/95 |
| 3,398,839 | A * | 8/1968 | Ballenger et al. | 211/85.15 |
| 3,945,543 | A * | 3/1976 | Lazaroff | 223/88 |
| 4,023,762 | A * | 5/1977 | Batts et al. | 223/85 |
| 5,505,351 | A * | 4/1996 | Najarian | 223/85 |
| 5,553,706 | A | 9/1996 | Gold | |
| 6,497,347 | B1 * | 12/2002 | Feibelman et al. | 223/87 |
| 2005/0284008 | A1 | 12/2005 | Hayes et al. | |
| 2006/0037981 | A1 * | 2/2006 | Dedo | 223/87 |
| 2010/0108846 | A1 | 5/2010 | Boscolo | |
| 2010/0282787 | A1 | 11/2010 | Williams | |

FOREIGN PATENT DOCUMENTS

| | | |
|---|---|---|
| EP | 1 947 026 A1 | 7/2008 |
| FR | 2 364 639 A1 | 4/1978 |
| GB | 2 058 001 A | 4/1981 |

OTHER PUBLICATIONS

PCT International Search Report dated Oct. 12, 2011, 12 pages.

* cited by examiner

*Primary Examiner* — Nathan Durham
(74) *Attorney, Agent, or Firm* — Christian M. Best; Amy M. Foust

(57) ABSTRACT

A hanger for storing and/or displaying an article to be worn, such as an article of clothing. The hanger may be adapted to be joined to a fastener on the article of clothing. A method for displaying an article to be worn may include providing an article having a fastener, providing a hanger having a complementary fastener, and joining the article to the hanger by the fastener.

20 Claims, 9 Drawing Sheets

PACKAGE FOR AN ARTICLE TO BE WORN

CROSS REFERENCE TO RELATED APPLICATIONS

This application claims the benefit of U.S. Provisional Application No. 61/367,983, filed on Jul. 27, 2010, which is hereby incorporated by reference in its entirety.

FIELD OF THE INVENTION

This disclosure relates to packaging for storing and displaying an article to be worn, such as an article of clothing, and further relates to methods of using the packaging to facilitate use of the article, including a hanger for articles to be worn.

BACKGROUND OF THE INVENTION

Clothing and other articles to be worn, including, for example, hats, shoes, and underwear, are often displayed in retail space by hooks, hangers, or hangtags (collectively, hangers). Hanging articles may keep them neat (e.g., not wrinkled), minimize the space required to hold multiple variants of the articles (such as different colors or sizes), and present an aesthetically pleasing way to view articles available for purchase. The same hangers may be used by a consumer to store an article at home.

Some articles, such as underwear, may be clipped to a hanger. However, the clip may not secure fabrics with a silky texture, which may lead to the articles disengaging from the hanger and falling, or the clip may leave undesirable impressions in the article from a secure press-fit, or may even damage the article. Some articles, such as clothing or shoes, may be further attached to a hanger by additional fasteners that bind the article to the hanger. Such additional fasteners may include stitches sewn through or around the hanger, or fasteners like the thin plastic strands with flattened ends that are sometimes referred to as tagging barbs. However, such additional fasteners may interfere with a consumer's manipulation of the article prior to purchase by, for example, preventing the consumer from trying on the article for size or holding the article against a body to assess likely fit. Further, such threads may be frustrating for a consumer to remove prior to using or wearing the article, and improper removal may damage the article.

Hangers may be marked to help a consumer find a specific variant of an article. For example, the hangers may be color-coded or may be marked with numbers or letters to indicate the size of the article on the hanger. However, the color-code or other indicia may not be useful to the consumer beyond selecting a size, color, or other variant of the article. For example, the color-code or other indicia may not help the consumer understand how to use or care for the article.

There remains a need for a retail display hanger for an article which can both securely hold and easily release an article. There remains a need for a hanger which facilitates the use of and care for an article after it is purchased.

SUMMARY OF THE INVENTION

In some aspects, the invention relates to a hanger for an article of clothing. The hanger may comprise a hook and a body connected to a hook. The body may comprise a releasable and refastenable fastener. The releasable and refastenable fastener may be adapted to join the hanger to one or more releasable and refastenable fasteners on an article of clothing.

The body may be shaped generally like an article of clothing for which the hanger is intended to be used. The body may comprise instructions for using or caring for an article of clothing. The instructions, if present, may comprise graphic icons or written words. The body may simulate an accessory used with an article of clothing for which the hanger is intended to be used. The body may be disposed inside the article of clothing during use. The body may be folded during use. The body may comprise instructions for using or caring for the article of clothing on at least two surfaces. At least one of the two surfaces may not be visible when the hanger is joined to the article of clothing.

The releasable and refastenable fastener may be a mechanical fastener. The mechanical fastener may be selected from the group consisting of buttons, button holes, zippers, snaps, ties, hook-and-loop, hook-and-hook, tab-and-slot, and combinations thereof. The hanger may comprise at least two releasable and refastenable fasteners. The hanger may comprise indicia designating the size of the article of clothing. The hanger may comprise a recyclable or recycled material. The hanger may comprise molded pulp, paper, paperboard, cardboard, craftboard, or combinations thereof.

In other aspects, the invention relates to a method of displaying an article of clothing. The method may comprise providing an article of clothing, the article of clothing comprising one or more releasable, refastenable fasteners. The method may comprise providing a hanger comprising one or more releasable, refastenable fasteners. The releasable, refastenable fasteners on the hanger may be complementary to the releasable, refastenable fastener or fasteners on the article of clothing. The method may comprise joining the hanger to the article of clothing by at least one of the one or more releasable, refastenable fasteners. The hanger may comprise a body. The hanger may be attached to the article of clothing such that the body simulates an accessory for the article of clothing. The method may comprise providing instructions for using or caring for the article of clothing. The instructions may be disposed on the body of the hanger. The method may comprise providing one or more indicia on the hanger. The indicia may indicate a feature or characteristic of the article of clothing. The indicia may be visible when the hanger is joined to the article of clothing.

DETAILED DESCRIPTION OF THE INVENTION

As used herein, "icon" refers to a graphic display intended to communicate information via drawings or symbols. An icon may be a simple line drawing meant to show an object or action without words. Exemplary, non-limiting icons include those described in ASTM Standard D5489-07, Standard Guide for Care Symbols for Care Instructions on Textile Products.

As used herein, "image" refers to a photograph or artwork which mimics, in quality, detail, and realism, a photograph.

In some aspects, this disclosure describes a hanger which may be adapted to be joined to a fastener on an article to be worn, such as an article of clothing. The hanger may comprise a releasable, refastenable fastener, such as a button or a snap member, which may be joined to a releasable, refastenable fastener on the article, such as a button hole or a complementary snap member. In some embodiments, the hanger can be joined directly to the article such that the article is securely attached to the hanger (e.g., the article is unlikely to fall off the hanger unintentionally) with no external fasteners (e.g., loop closures or fastening barbs). The hanger may comprise a body. The body may be configured to support and/or display the article. The body may comprise instructions for using or caring for the article. The body may simulate an accessory for the article. By simulating an accessory for the article, the presence of the body may help a consumer understand how to use the article with the accessory.

Figure 1:
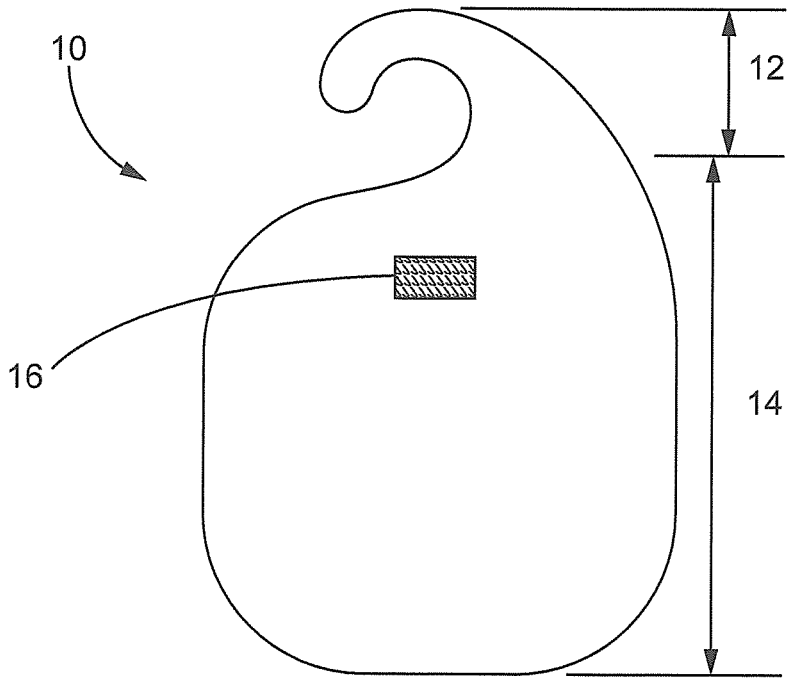
FIG. 1 is a plan view of an exemplary hanger.
Figure 2:
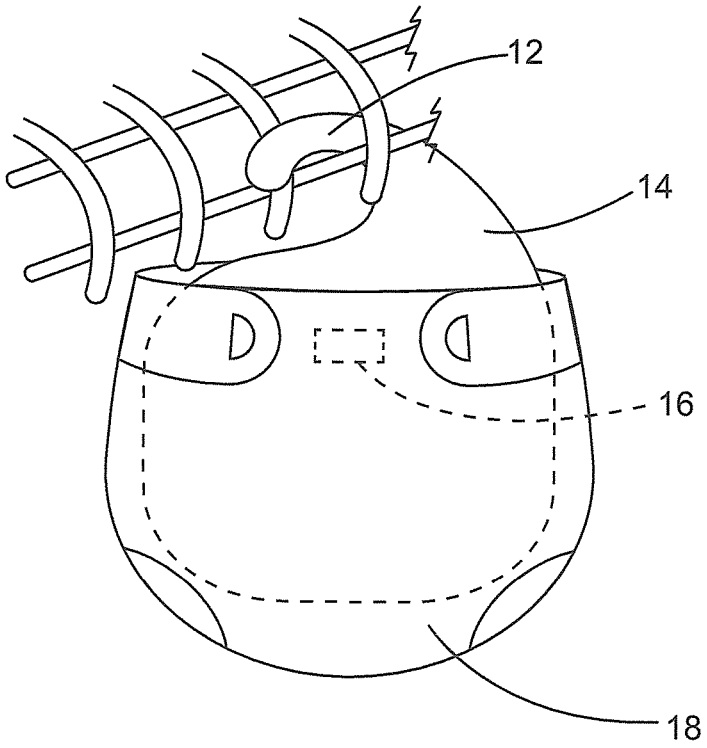
FIG. 2 is a perspective view of an exemplary hanger having an open hook, with an article attached.
Figure 3:
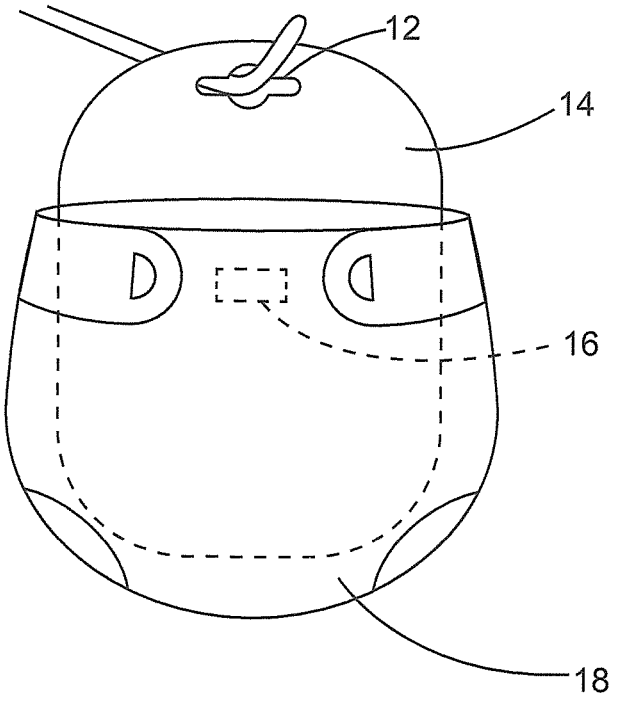
FIG. 3 is a perspective view of an exemplary hanger having an enclosed hook, with an article attached.
Figure 4:
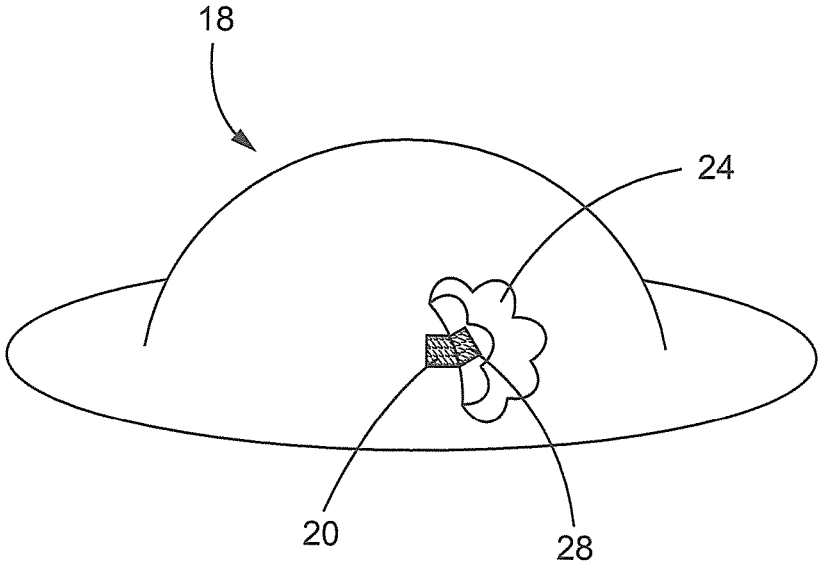
FIG. 4 is a perspective view of an exemplary article with an attached accessory.

An exemplary hanger 10 is shown in FIG. 1, with hook 12 and body 14. Hook 12 may be adapted to hang from a rack or wire shelf, as shown in FIG. 2, with article 18 attached to hanger 10 and covering part of body 14. "Hook" 12 may, alternatively, comprise an enclosed opening, as shown in FIG. 3, which may be used to hang hanger 10 from a bar, for example, from a bar on an adjustable display board or display shelf. In some embodiments, hanger 10 may not comprise a hook portion. For example, hanger 10 may be intended to be displayed flat on a shelf or other surface, or hanger 10 may be intended to be displayed hung from a holder, such as a clothes pin, a clip, or the like.

Body 14 may comprise fastener 16. Fastener 16 may be releasable and refastenable. That is, fastener 16 may be designed to connect, disconnect, and reconnect to a second, complementary fastener without appreciable damage to fastener 16, body 14, or article 18. A complementary fastener refers to a second fastener which is intended to mate with a first fastener. For example, a first fastener may be a button and a second fastener may be a button hole, or a first fastener may comprise hooks and the second fastener may comprise loops, or a first fastener may comprise the female member of a snap and the second fastener may comprise the male member of a snap. Fastener 16 may be selected to complement a fastener 20 in or on article 18. A complementary fastener is not intended to refer to a fastener which is not specific to its mate. For example, loops which can be wrapped around any suitably sized supporting structure, or a press-fit "fastener", such as a clip or clothespin, are not complementary fasteners for the purposes of this disclosure.

Fastener 20 may be present in article 18 for the purpose of joining article 18 to hanger 10, or fastener 20 may be present in article 18 for other purposes. For example, article 18 may be a shirt or blouse, and fastener 20 may be used to reduce or close an opening in the shirt or blouse. For example, fastener 20 may be a button on a button-down shirt, or a hook for a hook-and-eye fastening system at the neck of the shirt, or a hook-and-loop fastener for forming a waist opening in an absorbent article. Fastener 20 may be present on article 18 as a decorative feature. For example, fastener 20 may comprise a zipper, snap, or button which is not used to close, secure, or perform other functions when article 18 is worn, but adds visual interest or aesthetic appeal. Fastener 20 may be present to join article 18 to an accessory 24. For example, fastener 20 may be intended to facilitate the attachment of a flower, bow, or other ornament to a hat; or to connect a scarf to a blouse or jacket; or to facilitate the attachment of shoulder pads to a shirt or jacket.

Body 14 may be generally shaped to fill in article 18. For example, body 14 may hold article 18 in approximately the shape it would have when worn. In these embodiments, body 14 may help to display article 18 in a manner which helps a consumer visualize how or where the article is worn, or how the article will look when worn (as opposed to how the article looks on a conventional hanger or folded on a shelf). In some embodiments, body 14 is not significantly bigger than necessary to hold fastener 16. That is, in some embodiments, body 14 does not serve other functions, such as shaping or filling article 18. If article 18 is adapted to be used with an accessory, body 14 may simulate accessory 24. For example, body 14 may resemble, in shape, color, or other aspects of appearance, a flower, bow, or other ornament for a hat, as shown in FIGS. 4 and 5A-5C. Body 14 may be disposed inside article 18 when article 18 is attached to hanger 10, as shown in FIGS. 2-3, or may be disposed outside article 18 when article 18 is attached to hanger 10, as suggested by FIG. 4.

Figure 5A:
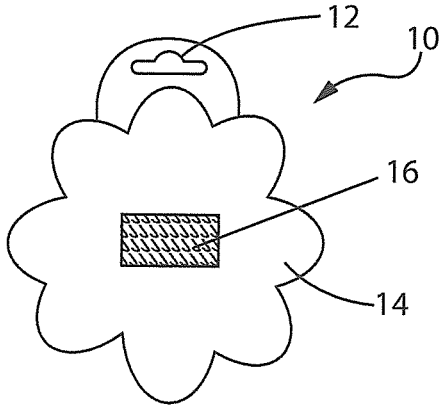
FIG. 5A is a plan view of the rear side of an exemplary hanger.
Figure 5B:
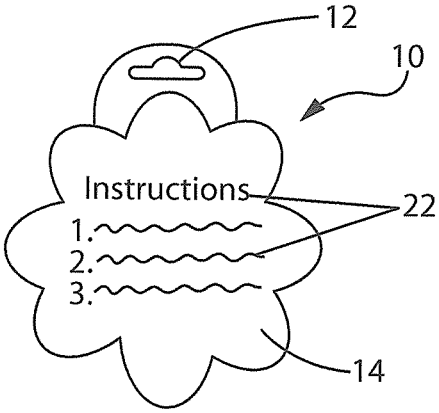
FIG. 5B is a plan view of the front side of an exemplary hanger.
Figure 5C:
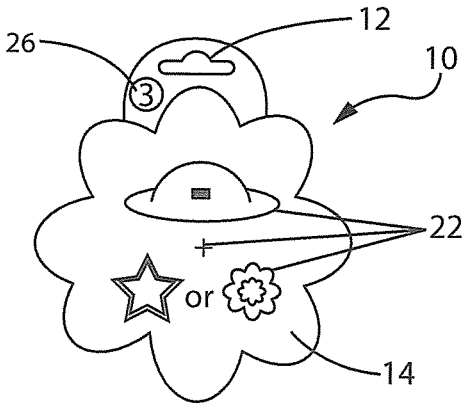
FIG. 5C is a plan view of the front side of an exemplary hanger.

Body 14 may comprise indicia 22 providing instructions for using or caring for article 18. For example, body 14 may provide instructions for applying article 18 to a wearer, or may provide instructions for laundering article 18. If article 18 is adapted to be worn with an accessory 24, body 14 may provide instructions for attaching, adjusting, removing, or caring for accessory 24. In some embodiments, body 14 simulates accessory 24, providing a consumer with an intuitive example for how to attach and/or remove accessory 24. For example, a consumer may remove body 14 and attach accessory 24 in approximately the same location, using the same type of fastening system. If body 14 comprises instructions, the instructions may be written in words, as shown in FIG. 5B, or the instructions may include graphic icons, as shown in FIG. 5C, or the instructions may include both written instructions and graphic icons. Graphic icons may include images showing, for example, how to remove article 18 from hanger 10; how to assemble article 18 with accessory 24, if appropriate; or what conditions are appropriate for washing and/or drying article 18 or accessory 24. Hanger 10 may, in addition to or instead of any instructions on body 14, include one or more markings 26 to help distinguish variants of article 18. For example, as shown in FIG. 5C, marking 26 may provide a numerical indication of some property of article 18, such as size, style, or color. Marking 26 may facilitate the selection of article 18 from a large grouping of articles which are similar, but not the same. Marking 26 may comprise numbers, letters, words, icons, or images. Instead of or in addition to marking 26, hook 12 or body 14 may comprise a color, pattern, icon, or image which indicates some property of article 18.

Figure 6:
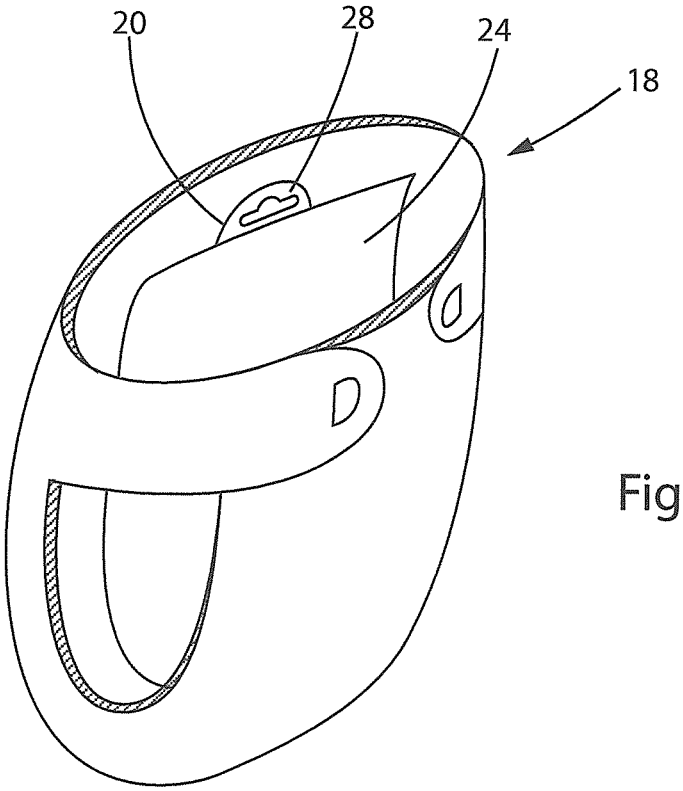
FIG. 6 is a perspective view of an exemplary article in the form of an absorbent article.

In some embodiments, as shown in FIG. 6, article 18 is an absorbent article, or a component of an absorbent article. Absorbent articles worn on or near the body may be used to capture and store body exudates, such as urine, feces, menses, and the like. Absorbent articles may be disposable. That is, they may be intended to be worn for some period or time, or until they have been soiled with one or more body exudates, and then discarded. Absorbent articles may include reusable components. For example, an absorbent article may have a reusable outer cover. The reusable outer cover may be used, for example, with disposable inserts. The disposable insert may provide absorbency, and the reusable outer cover may comfortably hold the disposable insert in place. A reusable outer cover may also be used with a reusable absorbent insert, such as a cloth diaper. Relative to a fully disposable absorbent article, a reusable outer cover may provide environmental benefits, even when used with a disposable absorbent insert. For example, the reusable outer cover may reduce the amount of waste that will be disposed of in a landfill, relative to a disposable absorbent article. In some embodiments, article 18 may be a reusable outer cover for an absorbent article.

Figure 7:
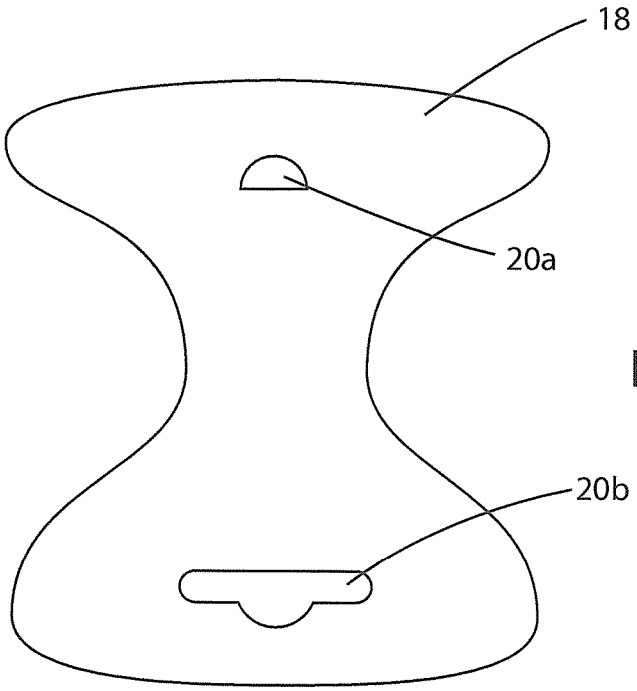
FIG. 7 is a plan view of an exemplary article in the form of an outer cover for an absorbent article.
Figure 8B:
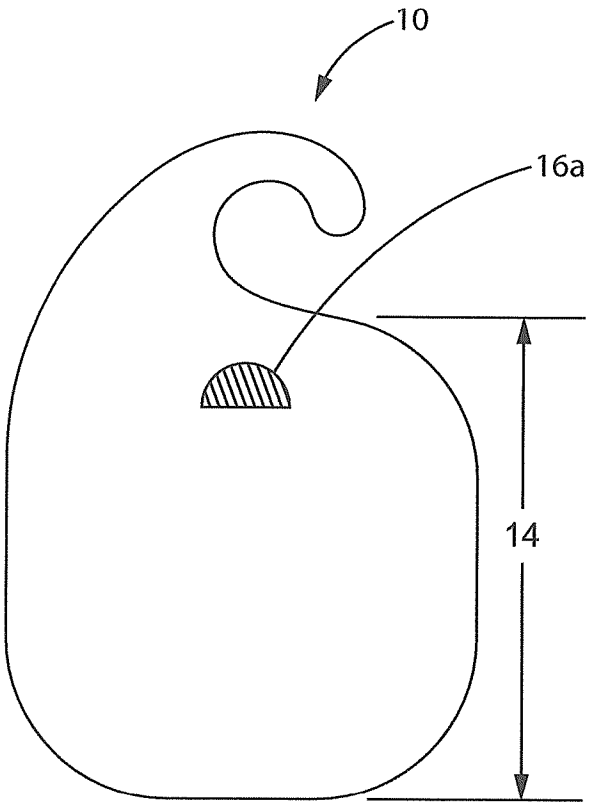
FIGS. 8A and 8B are plan views of opposing front and rear sides of an exemplary hanger.
Figure 8A:
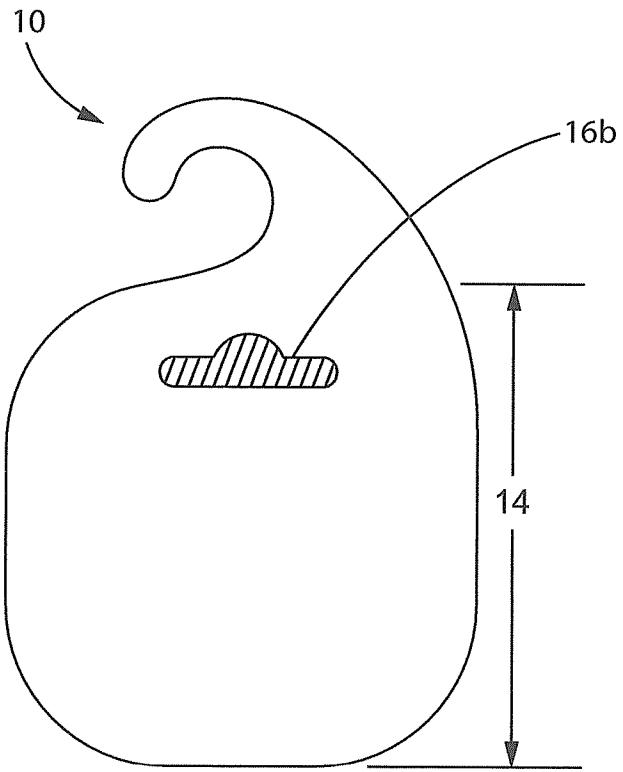

As shown in FIG. 6, in which article 18 is a reusable outer cover for an absorbent article, article 18 may comprise fastener 20, which may be complementary to fastener 28 in accessory 24. As shown in FIG. 6, accessory 24 may be an absorbent insert for an absorbent article. As shown in FIG. 7, article 18 may have at least two fasteners, 20*a* and 20*b*. Fasteners 20*a* and 20*b* may be of the same or different types of fastening systems. For example, fastener 20*a* may be the female portion of a snap, and fastener 20*b* may be the hook section of a hook-and-loop fastener, or fasteners 20*a* and 20*b* may each comprise the hook section of a hook-and-loop fastener. In Fasteners 20*a* and 20*b* may have similar shapes and sizes, or, as shown in FIG. 7, fasteners 20*a* and 20*b* may be of different sizes and/or shapes. This may be useful, for example, if accessory 24 is intended to be attached to article 18 in a specific position or orientation. Accessory 24 may have fasteners 28 which are complementary to fasteners 20*a* and 20*b* in article 18. If fasteners 20*a* and 20*b* are of different types, accessory 24 is most easily joined to article 18 when the complementary fasteners are aligned because the complementary fasteners will mate correctly. Alternately, if fasteners 20*a* and 20*b* are of the same type of fasteners, they may have different sizes or shapes, and the fasteners 28 on accessory 24 may be sized and shaped such that matching fasteners 28 of like size and shape in accessory 24 to fasteners 20 in article 18 results in joining accessory 24 to article 18 in the desired position or orientation. Hanger 10 may have fasteners 16*a* and 16*b* on opposing, front and back sides of body 14, as shown in FIGS. 8A and 8B. Fasteners 16*a* and 16*b* may be of fastener types, sizes, and shapes selected to match fasteners 20*a* and 20*b*, such that article 18 can be joined to the front side of hanger 10 by joining fastener 20*a* to fastener 16*a*, and joining fastener 10*b* to fastener 16*b*.

Figure 9:
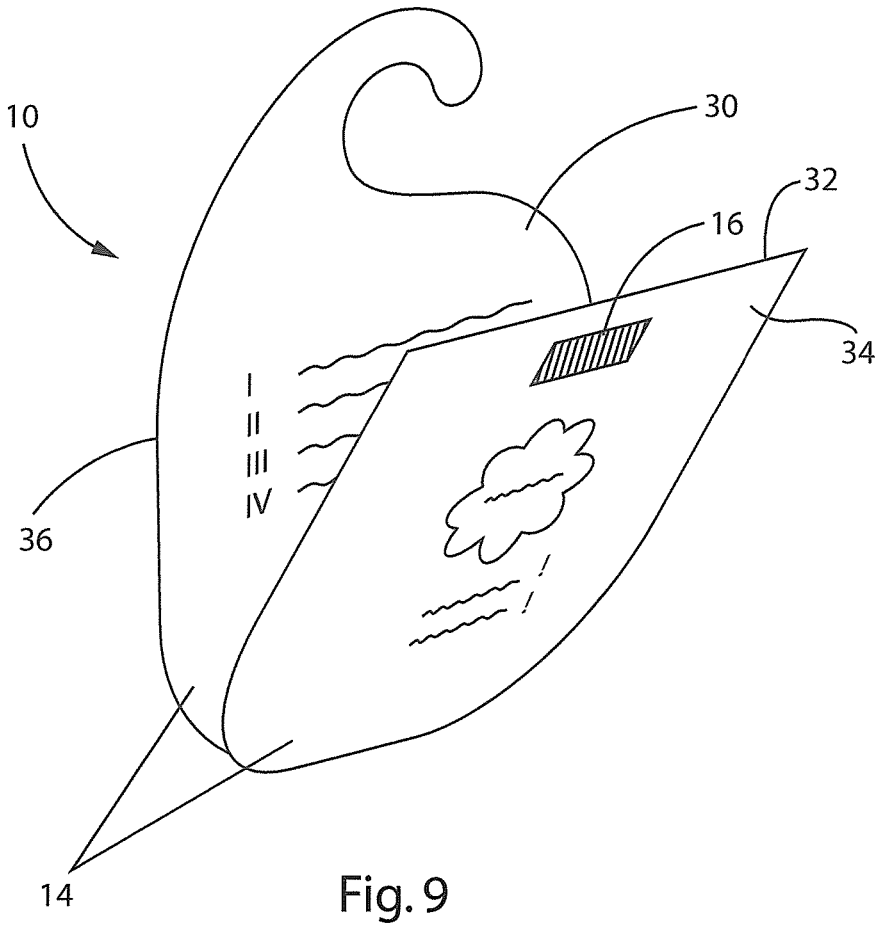
FIG. 9 is a perspective view of an exemplary hanger with a folded body.

Body 14 of hanger 10 may be folded, as shown in FIG. 9, creating inside surfaces 30, 32, and outside surfaces 34, 36. Any or all of surfaces 30, 32, 34, and 36 may include indicia 22. If hanger 10 is folded, it may be desirable to place fastener 16 on an outside surface 34 or 36 of hanger 10. With fastener 16 on an outside surface 34, 36, article 18 can be attached to outside surface 34 or 36, with body 14 of hanger 10 disposed inside article 18. Such an embodiment may be desirable to highlight the appearance of article 18 when it is displayed, for example, because body 14 of hanger 10 may be at least partially covered by article 18. Thus, a consumer can see and touch article 18 before purchase. Fastener 16 may also be disposed on an inside surface 30, or 32. In such an embodiment, article 18 may be attached to inside surface 30 or 32. At least a portion of body 14 may wrap around article 18. Article 18 may be partially gathered or folded inside the folded portion of body 14, or body 14 may be long enough that the full dimensions of article 18 are accommodated inside body 14 even when it is folded. Placing article 18 inside body 14 may, for example, protect article 18 from damage or soiling during transportation or storage, or may highlight indicia 22 or markings 26 on hanger 10.

Figure 10:
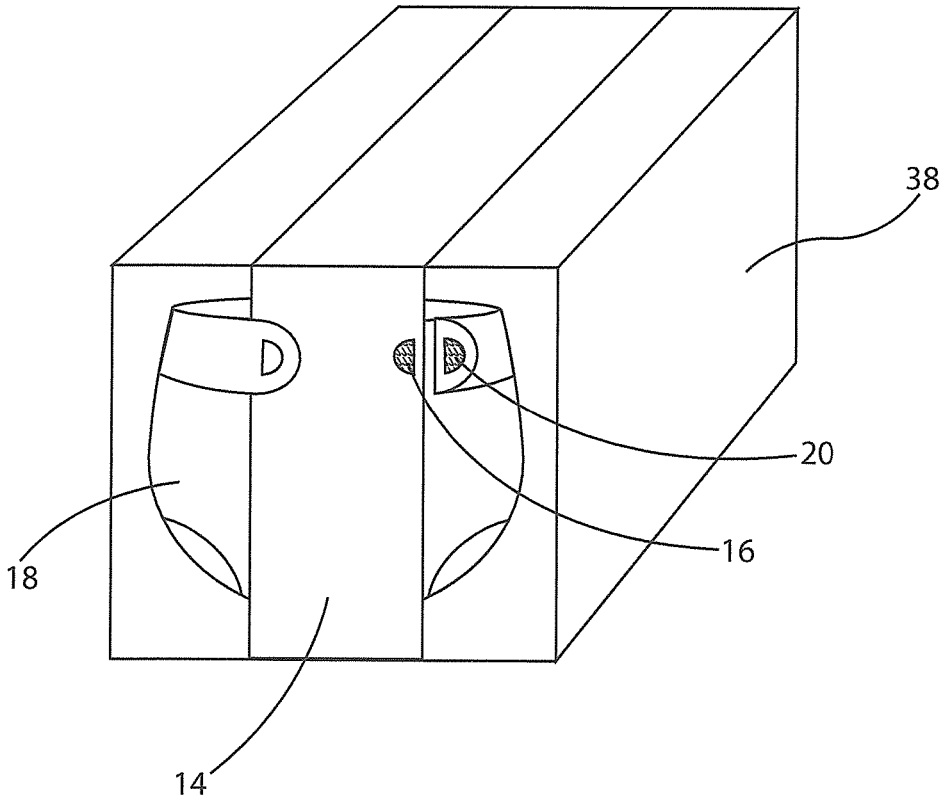
FIG. 10 is a perspective view of exemplary packaging including an exemplary hanger in the form of a band.

In some embodiments, hanger 10 does not have hook 12. Instead, body 14 may comprise a strip of material that is bound by fastener or fasteners 16 on body 14 to fastener or fasteners 20 on article 18. Article 18 may be folded with body 14, or, as shown in FIG. 10, article 18 may be secured by body 14 to another object or surface, such as box 38. Body 14 may wrap entirely around all four sides of box 38, or body 14 may be secured via any suitable means to any desired location on box 38. For example, body 14 may be secured to article 18 by fasteners 16, and be stapled, taped, stitched, hot-melted, glued, or otherwise attached to box 38.

Although the discussion has focused on attaching article 18 to hanger 10, it should be understood that hanger 10 may also be used to display and store accessories 24, as desired.

Hanger 10 may be made by any suitable process, including thermoform, injection molded, die-cast or die-cut. In some embodiments, hanger 10 is formed from molded pulp, paper, paperboard, cardboard, craftboard, or the like. The material may be coated, as with wax, clay, lacquers, varnishes, or combinations of these coatings to help the package resist humidity or dampness and/or to facilitate printing or protect printed images on the package from degradation. The material may be laminated to a second material. Such materials may facilitate printing indicia 22 on hanger 10. Such materials may also be recyclable and/or include recycled content. If a recyclable hanger 10 is used with another object or surface, such as box 38, it may be desirable that the other object or surface also be recyclable. The materials of hanger 10 and object or surface 38 are not necessarily the same. Using different materials, or treating the same materials to provide a different appearance, may improve the appearance of hanger 10 and object or surface 38, or may highlight indicia 22 on hanger 10. Using different materials may also provide a pleasant or interesting tactile sensation when handling hanger 10 and box 38. In some embodiments, as when article 18 is a reusable absorbent article or a component of a reusable absorbent article, using different materials, each of which is recyclable, may be used to reinforce an eco-friendly message. For example, different consumers may recognize different kinds of materials as recyclable. Thus, if the packaging includes two or three or more different materials, a consumer may recognize one of the materials as recyclable and surmise that the others are also likely recyclable, even if the other material or materials are unfamiliar to the consumer. Using different materials may also create visual and/or textural interest in the package. For example, the package may feel more interesting if the different materials provide different tactile sensations when the package is touched or handled.

Figure 11:
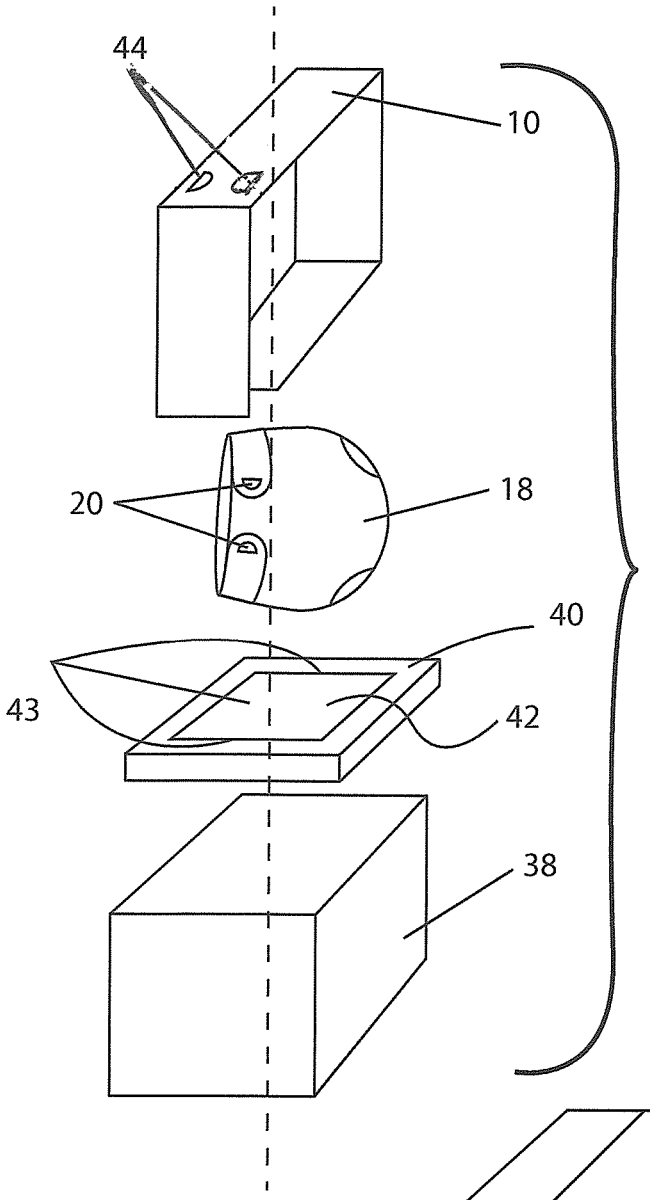
FIG. 11 is an exploded view of an exemplary packaging configuration including an exemplary hanger in the form of a band.
Figure 12:
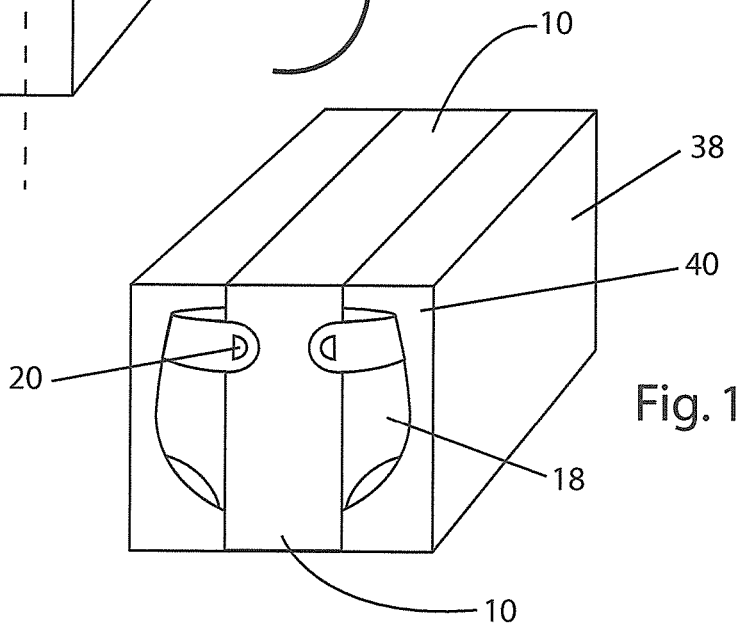
FIG. 12 is a perspective view of an exemplary, assembled packaging configuration including an exemplary hanger in the form of a band.

If box 38 (or other container of suitable shape and size for the articles to be packaged, such as a hatbox or tub) is provided, box 38 may include tray 40 on at least one surface for displaying a sample of article 18. Tray 40 may be formed with recess 42 having a perimeter 43 shaped generally like the silhouette of article 18, as shown in FIG. 11. Article 18 may be placed in tray 40, which is situated in or on the surface of box 38, and body 14 of hanger 10 may be wrapped around article 18, tray 40, and box 38, such that article 18 is secured to the surface of box 38, but is at least partially exposed, such that a consumer can see and touch article 18 without opening box 38. Hanger 10 may have hook 12, or no hook. In embodiments where article 18 includes functional fasteners 20, such as fasteners 20 which are used to create a waist opening in an absorbent article, as shown in FIG. 11, hanger 10 may comprise cut-outs 44 instead of or in addition to fastener(s) 16. Cut-out(s) 44 may allow article 18 to be secured to itself through or around hanger 10, such that article 18 is securely seated on hanger 10 without being joined directly to hanger 10. When assembled, box 38, tray 40, article 18, and hanger 10 may form a substantially smooth outer surface on box 38, as shown in FIG. 12. That is, the complete assembly may not protrude out of the plane of the face of box 38, although the complete assembly may at points protrude inward of the plane of the face of box 38. A substantially smooth outer surface on box 38 may facilitate shipping and stacking box 38, and may help prevent damage to article 18 during shipping, storage, and/or display, as article 18 may be less likely to snag on other objects or be displaced or torn if it does not protrude from the plane of the face of box 38.

In addition to the article 18 disposed on the outside of box 38, one or more articles 18 and/or accessories 24 may be disposed inside box 38. This may be desirable, for example, if article 18 is an outer cover for an absorbent article, and accessory 24 is an absorbent insert. In some embodiments, such as embodiments wherein article 18 is a reusable outer cover and accessory 24 is a disposable absorbent insert, article 18 may be able to withstand some exposure to the environment during shipping, display, and/or storage, without irreversible damage. For example, article 18 may be launderable, such that if article 18 becomes dusty, it can be washed and remain fully functional. If accessory 24 is a disposable absorbent insert, or is particularly delicate or ornate, it may be difficult or impossible to recondition accessory 24 if it becomes dusty, soiled, or disheveled during shipping, display, and/or storage. Thus, using box 38 may facilitate displaying at least one article 18 on the outside of box 38, where article 18 is simultaneously sold with at least one accessory 24 which is inside box 38 for protection during shipping, display, and/or storage.

For recycled and/or recyclable products and/or packaging, it may be desirable to provide box 38 with dimensions which increase the surface area to volume ratio of the box, so as to increase the volume of contents box 38 can hold relative to the amount of material making up box 38. For example, if box 38 is a cube or cuboid (e.g., if one side of box 38 is approximately square or rectangular), it may be desirable that no one side has a length that is more than 2 times, or more than 1.5 times, or more than 1.2 times the length of another side.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A combination comprising:

a reusable outer cover configured to be joined to an insert, wherein the insert is configured to capture and store body exudates, wherein the reusable outer cover comprises a first fastener for the insert in a front waist region and a second fastener for the insert in a rear waist region, and wherein the first and second fasteners both have a portion on a longitudinal axis of the reusable outer cover; and a hanger comprising:

a body; and a hook extending from the body, wherein the body comprises a first side and a second side, wherein the first side comprises a third fastener configured to be joined with the first fastener of the reusable outer cover, and wherein the second side comprises a fourth fastener configured to be joined with the second fastener of the reusable outer cover.

2. The combination of claim 1, wherein the first and second fasteners have the same size or shape.

3. The combination of claim 1, wherein the first and second fasteners have a different size or shape.

4. The combination of claim 1, wherein the first and third fasteners together form a first hook and loop fastener, and wherein the second and fourth fasteners together form a second hook and loop fastener.

5. The combination of claim 1, wherein the first and third fasteners together form a releasable and refastenable fastener, and wherein the second and fourth fasteners together form a releasable and refastenable fastener.

6. The combination of claim 1, wherein the reusable outer cover surrounds a portion of the body when positioned on the hanger.

7. The combination of claim 1, wherein the first and third fasteners have a first size and shape, and wherein the second and fourth fasteners have a different size and shape.

8. The combination of claim 1, wherein the hanger comprises instructions for using or caring for the reusable outer cover.

9. The combination of claim 1, comprising a disposable absorbent insert configured to be engaged with the first fastener and the second fastener of the reusable outer cover.

10. The combination of claim 1, wherein the reusable outer cover is a tape-style outer cover comprising a first waist fastener and a second waist fastener.

11. A combination comprising:

a reusable outer cover configured to be joined to a disposable absorbent insert, wherein the disposable absorbent insert is configured to capture and store body exudates, wherein the reusable outer cover comprises a first fastener for the insert in a front waist region and a second fastener for the insert in a rear waist region, and wherein the first and second fasteners are both positioned proximate to a waist edge of the reusable outer cover; and a hanger comprising:

a body; and a hook extending from the body, wherein the body comprises a first side and a second side, wherein the first side comprises a third fastener configured to be joined with the first fastener of the reusable outer cover, and wherein the second side comprises a fourth fastener configured to be joined with the second fastener of the reusable outer cover;

wherein the first fastener is complimentary to the third fastener, and wherein the second fastener is complimentary to the fourth fastener.

12. The combination of claim 11, wherein the first and second fasteners have a different size and shape.

13. The combination of claim 11, wherein the third and fourth fasteners have a different size and shape.

14. The combination of claim 11, wherein the first and third fasteners together form a first hook and loop fastener, and wherein the second and fourth fasteners together form a second hook and loop fastener.

15. The combination of claim 11, wherein the first and third fasteners together form a releasable and refastenable fastener, and wherein the second and fourth fasteners together form a releasable and refastenable fastener.

16. The combination of claim 11, wherein the reusable outer cover surrounds a portion of the body when positioned on the hanger.

17. The combination of claim 11, wherein the body comprises instructions for using or caring for the reusable outer cover.

18. The combination of claim 11, comprising a disposable absorbent insert configured to be engaged with the first fastener and the second fastener of the reusable outer cover.

19. A combination comprising:

a tape-style reusable outer cover configured to be joined to a disposable absorbent insert, wherein the disposable absorbent insert is configured to capture and store body exudates, wherein the tape-style reusable outer cover and the disposable absorbent insert together form an absorbent article, wherein the reusable outer cover comprises a first fastener for the disposable absorbent insert in a front waist region and a second fastener for the disposable absorbent insert in a rear waist region, and wherein the first and second fasteners both have a portion on a longitudinal axis of the reusable outer cover; and a hanger comprising:

a body, wherein the body comprises instructions for using or caring for the reusable outer cover; and a hook extending from the body, wherein the body comprises a first side and a second side, wherein the first side comprises a third fastener configured to be joined with the first fastener of the reusable outer cover, and wherein the second side comprises a fourth fastener configured to be joined with the second fastener of the reusable outer cover;

wherein the first fastener is complimentary to the third fastener, and wherein the second fastener is complimentary to the fourth fastener.

20. The combination of claim 19, wherein the hanger comprises indicia designating the size of the reusable outer cover.

* * * * *